US010219355B2

(12) United States Patent
Clout et al.

(10) Patent No.: US 10,219,355 B2
(45) Date of Patent: Feb. 26, 2019

(54) LUMINAIRE FOR CONTROLLING A LIGHT OUTPUT OF A LIGHTING MODULE COMPRISING AT LEAST ONE LIGHT SOURCE

(71) Applicant: PHILIPS LIGHTING HOLDING B.V., Eindhoven (NL)

(72) Inventors: Ramon Antoine Wiro Clout, Eindhoven (NL); Jochen Renaat Van Gheluwe, Lommel (BE); Bartel Marinus Van De Sluis, Eindhoven (NL); Philip Steven Newton, Waalre (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/777,044

(22) PCT Filed: Nov. 16, 2016

(86) PCT No.: PCT/EP2016/077847
§ 371 (c)(1),
(2) Date: May 17, 2018

(87) PCT Pub. No.: WO2017/089195
PCT Pub. Date: Jun. 1, 2017

(65) Prior Publication Data

US 2018/0332689 A1 Nov. 15, 2018

(30) Foreign Application Priority Data

Nov. 26, 2015 (EP) ..... 15196483

(51) Int. Cl.
*H05B 33/08* (2006.01)
*H05B 37/02* (2006.01)

(52) U.S. Cl.
CPC ..... *H05B 37/0254* (2013.01)

(58) Field of Classification Search
None
See application file for complete search history.

(56) References Cited

U.S. PATENT DOCUMENTS 9,155,171 B1 10/2015 Hughes et al.
2004/0242053 A1 12/2004 Benavides et al.
(Continued)

FOREIGN PATENT DOCUMENTS

FR 2920367 A1 3/2009
WO 9103684 A1 3/1991
WO 2011002280 A1 1/2011

*Primary Examiner* — Dedei K Hammond

(57) ABSTRACT

A luminaire (100) for controlling a light output of a lighting module (106) comprising at least one light source is disclosed. The luminaire (100) comprises a housing (102) and a plurality of connectors (104, 105) for interfacing with the lighting module (106). Each connector (104, 105) has a position defined by a location relative to the housing (102) and an orientation relative to the gravitational field, wherein at least two connectors (104, 105) have different orientations. The luminaire (100) further comprises a processor (108) for detecting the lighting module (106) at a connector (104) and for accessing information indicative of the position of the connector (104). The processor (108) is further arranged for identifying the lighting module (106) based on a signal received from the lighting module (106), and for controlling the light output of the lighting module (106) based on the identification of the lighting module (106) and the position of the connector (104).

10 Claims, 4 Drawing Sheets

(56) References Cited

U.S. PATENT DOCUMENTS

| | | | | |
|---|---|---|---|---|
| 2010/0301679 | A1 | 12/2010 | Murray | |
| 2011/0178650 | A1 | 7/2011 | Picco | |
| 2012/0206050 | A1 | 8/2012 | Spero | |
| 2014/0001952 | A1 | 1/2014 | Harris et al. | |
| 2014/0168967 | A1* | 6/2014 | Itami | F21V 21/15<br>362/233 |

* cited by examiner

LUMINAIRE FOR CONTROLLING A LIGHT OUTPUT OF A LIGHTING MODULE COMPRISING AT LEAST ONE LIGHT SOURCE

CROSS-REFERENCE TO PRIOR APPLICATIONS

This application is the U.S. National Phase application under 35 U.S.C. § 371 of International Application No. PCT/EP2016/077847, filed on Nov. 16, 2016 which claims the benefit of European Patent Application No. 15196483.0, filed on Nov. 26, 2015. These applications are hereby incorporated by reference herein.

FIELD OF THE INVENTION

The invention relates to a luminaire for controlling a light output of a lighting module comprising at least one light source. The invention further relates to a lighting module for use in the luminaire. The invention further relates to a method of controlling a light output of a lighting module comprising at least one light source.

BACKGROUND

Current and future smart lighting devices are already or will be controlled digitally, which provides new control paradigms for such lighting devices. An example of such a smart lighting device is a modular USB luminaire, which comprises sockets arranged for receiving a variety of lamps and sensors. A user may for example remove a lamp, which is arranged for providing task lighting, from a first socket of the luminaire and replace this lamp with a lamp arranged for providing ambient lighting. A second socket of the same luminaire may be arranged for receiving a sensor, such as an occupancy sensor detecting a presence of the user, which provides a sensor signal to a central processing unit of the luminaire that controls a connected lamp accordingly. However, the functionality of such a modular luminaire system currently depends on how each of the connected sensors and/or lamps are configured (or commissioned). This configuration process may be cumbersome for an average user. Thus, there is a need in the art to configure the modules connected to the luminaire automatically.

SUMMARY OF THE INVENTION

It is an object of the present invention to provide a modular luminaire that configures connected modules automatically. It is a further object of the present invention to provide a modular luminaire that controls connected modules automatically. It is a further object of the present invention to provide a luminaire module arranged for interfacing with the luminaire accordingly.

According to a first aspect of the present invention, the object is achieved by a luminaire for controlling a light output of a lighting module comprising at least one light source, the luminaire comprising:

a housing, a plurality of connectors for interfacing with the lighting module, which connector has a position defined by a location relative to the housing and an orientation relative to the gravitational field, and wherein at least two connectors have different orientations, and a processor for detecting the lighting module at a connector, for accessing information indicative of the position of the connector, identifying the lighting module based on a signal received from the lighting module, and for controlling the light output of the lighting module based on the identification of the lighting module and the position of the connector.

By controlling the light output based on the position of the connector where the lighting module is connected to the luminaire, the processor is able to determine how the connected lighting module operates. The position (the location of the connector relative to the housing and the orientation of the connector), and therewith the position of the lighting module, determines how the processor configures and/or controls the lighting module. This provides the advantage that when the lighting module is connected to the luminaire, the light output of the lighting module is controlled based on its position. A user may, for example, connect a lighting module (e.g. an LED lamp) to a connector of a chandelier luminaire, which connector faces upwards. The processor may determine to control the light output of the lighting module according to an ambient light setting, while when the lighting module is connected to a downward facing connector, the processor may determine to control the light output of the lighting module according to a task light setting.

The position of the connector is defined by a location of the connector relative to the housing. The location of the connector (and therewith the location of a connected lighting module) relative to the housing may be determined associated with a unique address of the connector. Each connector may have its own address, and the processor may have access to these addresses. This is advantageous because it allows the processor to determine the location of a connector interfacing with a lighting module.

In an embodiment of the luminaire, the luminaire comprises an orientation sensor for providing an orientation signal indicative of an orientation of the orientation sensor to the processor, and the processor is further arranged for determining the orientation of the connector relative to the housing based on the orientation signal. This is beneficial, because it allows the processor to control the light output of the lighting module based on the orientation (e.g. the tilt) of the luminaire and/or the connector (and therewith the orientation of the lighting module) relative to the gravitational field.

In an embodiment of the luminaire, the orientation sensor is located in the housing of the luminaire. This embodiment may be advantageous when the orientation of the connector is fixed relative to the orientation of the housing, because when the orientation of the connector is fixed relative to the orientation of the housing, the processor is able to determine the orientation of the connector, and therewith the orientation of the lighting module, based on the orientation of the housing.

In an embodiment of the luminaire, the orientation sensor is located in the connector. This embodiment may be advantageous when the orientation of the connector is not fixed relative to the orientation of the housing. The luminaire may, for example, further comprise a connector orientation adjustment element, which connector orientation adjustment element is arranged for adjusting the orientation of the connector relative to the orientation of the housing. This enables the processor to determine the orientation of the connector, and therewith the orientation of the lighting module, based on the signal received from the orientation sensor. In an embodiment of the luminaire, each connector is arranged for interfacing with a sensor module comprising at least one sensor arranged for detecting an environmental condition of the connector or the luminaire, and the processor is arranged for controlling the mode of operation of the sensor module based on the position of the sensor module. This embodiment is advantageous, because it allows the processor to determine how the sensor operates (e.g. how the sensor senses its environment). In a further embodiment, the luminaire further comprises at least one light source (which may be connected to a further connector), and the processor is arranged for controlling the light output of the at least one light source based on the detected environmental condition. This provides the advantage that it enables the processor to control the light setting of the at least one light source.

In an embodiment of the luminaire, the processor is further arranged for controlling the light output of a further lighting module connected to a further connector of the plurality of connectors based on the light output of the lighting module. This allows the processor to, for example, determine the light output of a light emitting module based on the setting of another light emitting module, thereby possibly complementing the light output of the one light emitting module by the light output of the other lighting module.

According to a second aspect of the present invention, the object is achieved by a lighting module for use in the luminaire according to the luminaire of any one of the above-mentioned embodiments, the lighting module comprising:

a second connector for interfacing with one of the plurality of connectors of the luminaire, and a processor arranged for controlling the light output of the lighting module based on a control signal received from the luminaire.

According to a third aspect of the present invention, the object is achieved by a method of controlling a light output of a lighting module comprising at least one light source, the method comprising the steps of:

detecting the lighting module at a connector of a plurality of connectors, wherein each connector has a position defined by a location relative to a housing of a luminaire and an orientation relative to the gravitational field, and wherein at least two connectors have different orientations,—accessing information indicative of the position of the connector, identifying the lighting module based on a signal received from the lighting module, and controlling the light output of the lighting module based on the identification of the lighting module and the position of the connector.

In embodiments of the methods, the method further comprises the step of detecting an orientation of the connector. Detecting the orientation of the connector provides the advantage that it provides specific parameters, which parameters are used to determine the light output of the lighting module.

BRIEF DESCRIPTION OF THE DRAWINGS

The above, as well as additional objects, features and advantages of the disclosed luminaire, lighting module and methods, will be better understood through the following illustrative and non-limiting detailed description of embodiments of devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
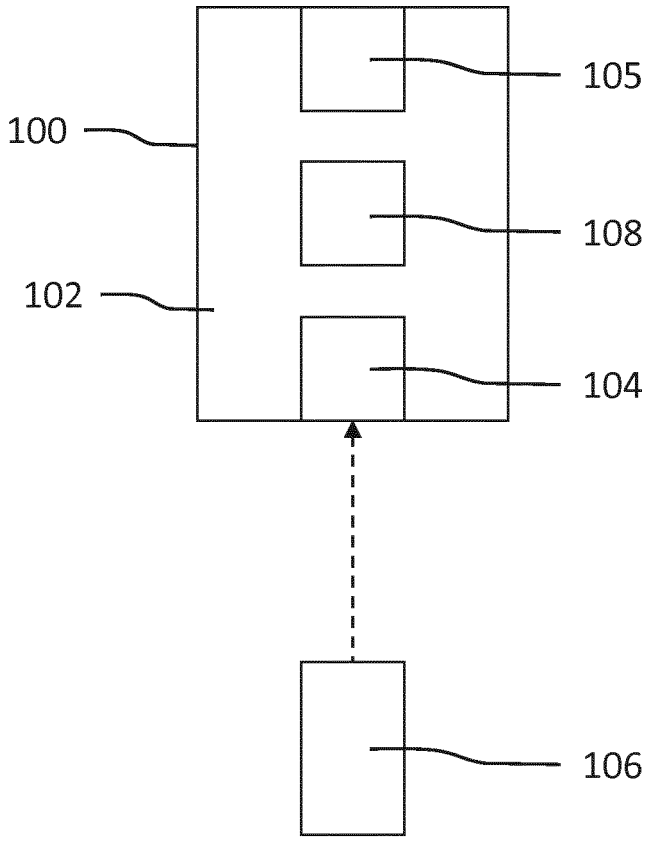
FIG. 1 shows schematically an embodiment of a luminaire according to the invention for controlling a light output of a lighting module.

FIG. 1 shows schematically an embodiment of a luminaire 100 according to the invention for controlling a light output of a lighting module 106. The luminaire 100 comprises a housing 102 and a plurality of connectors 104 for interfacing with the lighting module 106. Each of the connectors 104, 105 has a position relative to the housing, which position may be defined by a fixed location and an orientation relative to the gravitational field. The orientation may be detected by an orientation sensor. The luminaire 100 further comprises a processor 108 (e.g. a microcontroller, a microchip, circuitry, etc.) for detecting the presence of the lighting module 106 at a connector 104 of the plurality of connectors 104, 105 and for accessing information indicative of the position of the connector 104 (for example by receiving the information from an orientation sensor, accessing a memory storing a look-up table storing information about one or more connectors and their respective positions, etc.). The processor 108 is further arranged for identifying the lighting module 106 based on a signal received from the lighting module 106, and for controlling the light output of the detected lighting module 106 based on the identification of the lighting module 106 and the position of the respective connector 104. This enables the processor 108 to, for example, determine how to configure and/or control the lighting module 106, or how to interpret data received from the lighting module 106.

Each connector 104, 105 is arranged for interfacing with a lighting module 106. This interface (i.e. a connection) allows either one-directional or bidirectional data communication. This allows the processor 108 to identify, detect, control and/or configure the lighting module 106. The lighting module 106 may, for example, be a USB module and the connector 104, 105 may be a USB socket for receiving the lighting module 106. A connected USB module may communicate, for example, its idVendor and idProduct (which are standardized USB descriptors) to the processor 108, thereby allowing the processor 108 to identify the lighting module 106. The USB module may further communicate its device related properties (such as light emission properties, dimming properties, light colour, beam shape, sensing properties, etc.). The luminaire 100 may further comprise a memory for storing the properties of the identified lighting module 106.

The connectors 104, 105, which may be comprised in the housing 102 or may be located outside the housing 102, may be any connector 104, 105 arranged for interfacing with a lighting module 106. The connectors 104, 105 may have a fixed position relative to the housing 102, or the connectors 104, 105 may have an adjustable position relative to the housing 102. The connectors 104, 105 are arranged for interfacing with the lighting module 106, which lighting module 106 may be connected to a connector 104, 105 with a fixed position relative to the housing 102. By connecting the lighting module 106 to a connector 104, 105 with a fixed position relative to the housing 102, the processor 108 is able to determine the position of the lighting module 106 based on the position of the connector 104. The connector 104, 105 may, for example, be a socket (e.g. a screw socket (E14, E26, E27, etc.), a bayonet socket, a USB socket, a power over Ethernet socket, etc.) or a plug (e.g. a screw plug (E14, E26, E27, etc.), a bayonet plug, a USB plug, a power over Ethernet plug, etc.), but it may also be a connector 104, 105 that is arranged for connecting with the lighting module 106 via any other mechanical connection (for example a magnetic connection).

Figure 2A:
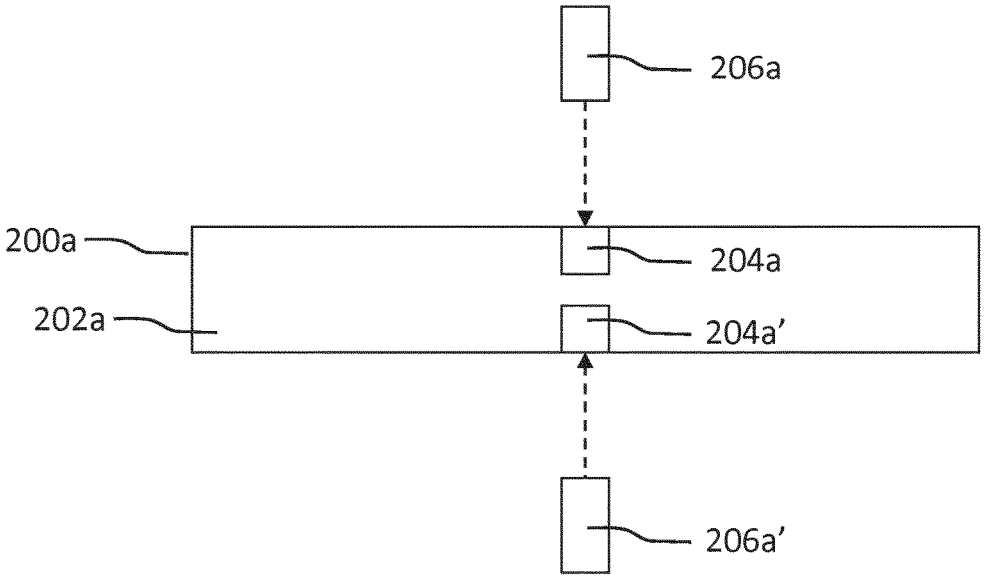
FIG. 2*a* shows schematically an embodiment of a luminaire according to the invention comprising a first and a second connector for interfacing with a first and a second lighting module.
Figure 2B:
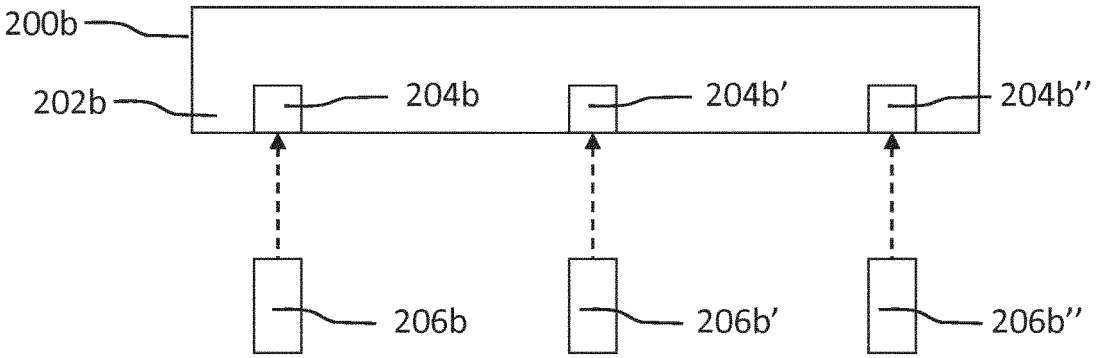
FIG. 2*b* shows schematically an embodiment of a luminaire according to the invention comprising a first, second and third connector for interfacing with a first, second and third lighting module respectively.

Each connector 104, 105 has a position relative to the housing 102. The position of a connector 104, 105 (and therewith the location of a connected lighting module 106) may be defined by a location of the connector 104, 105 relative to the housing 102. Each connector 104, 105 may be associated with a unique address, and the processor 108 may have access to these addresses, allowing the processor 108 to determine which connector 104, 105 is interfacing with which lighting module 106. FIG. 2*b* shows an example of a luminaire 200*b* comprising connectors 206*b*, 206*b*' and 206*b*" with positions are defined by locations of the connectors 204*b*, 204*b*', 204*b*" relative to the housing 202*b*. The luminaire 200*b* comprises a first connector 206*b* with a first location (left) relative to the housing 202*b*, which is associated with a first address A1. The luminaire 200*b* further comprises a second connector 206*b*' with a second location (center) relative to the housing 202*b*, which is associated with a second address A2. The luminaire 200*b* further comprises a third connector 206*b*" with a third location (right) relative to the housing 202*b*, which is associated with a third address A3. In this example, the processor (not shown) may have access to a memory (not shown) which stores the locations of the connectors 204*b*, 204*b*', 204*b*", for example as unique addresses A1, A2, and A3 which are associated with their locations. This allows the processor 108 to control the light output of a connected lighting module 206*b*, 206*b*', 206*b*" based on the location of the lighting module 206*b*, 206*b*', 206*b*".

The position of the connector 104, 105 may be represented by its orientation relative to the housing (which housing has an orientation relative to the gravitational field). The luminaire may, for example, have multiple connectors which each have their own orientation relative to the housing. FIG. 2*a* shows an example of such a luminaire 200*a*. The luminaire 200*a* in FIG. 2*a* comprises a first connector 204*a* with a first orientation (up) relative to the housing 202*a* and a second connector 204*a*' with a second orientation (down) relative to the housing 202*a* of the luminaire 200*a*. In this example, the processor (not shown) may have access to a memory (not shown) which stores the orientations of the connectors 204*a*, 204*a*'. This allows the processor to control the light output of a connected lighting module 206*a*, 206*a*' based on the orientation of the lighting module 206*a*, 206*a*'. In an embodiment wherein the position is determined by both the location and the orientation of the connector 204*a*, 204*a*', the processor is able to control the light output of a connected lighting module 206*a*, 206*a*' based on both the orientation and the location of the lighting module 206*a*, 206*a*'.

The processor 108 is arranged for identifying the lighting module 106 based on a signal received from the lighting module 106. Upon connecting the lighting module 106 to the connector 104, the connector 104 and the lighting module 106 interface, thereby allowing the processor 108 to receive a signal which identifies the lighting module 106.

The processor 108 is further arranged for controlling the light output of the lighting module 106 based on the identification of the lighting module 106 and the position of the connector 104 (and therewith the orientation of the lighting module 106). A lighting control signal is communicated to the lighting module 106, allowing the lighting module 106 to set its light output to the light output determined by the processor 108. This allows the processor 108 to configure/control the lighting module 106. FIG. 2*a* shows schematically an embodiment of a luminaire 200*a* according to the invention comprising a first connector 204*a* and a second connector 204*a*' for interfacing with a first lighting module 206*a* and a second lighting module 206*a*'. The first connector 204*a* is located at the top side of housing 202*a* of the luminaire 200*a*, and it is oriented upwards. The second connector 204*a*' is located at the bottom side of the housing 202*a* of the luminaire 200*a*, and it is oriented downwards. In the exemplary embodiment of FIG. 2*a*, the positions (locations and/or orientations) of the connectors 204*a*, 204*a*' are fixed relative to the housing 202*a*. The next examples illustrate how the processor (not shown) may control the light output of the first lighting module 206*a* and the second lighting module 206*a*' based on their orientation relative to the housing 202*a*.

In a first example, the luminaire 200*a* may be a pendant lamp hanging on a ceiling. A user may connect the first lighting module 206*a* to the first connector 204*a* and the second lighting module 206*a*' to the second connector 204*a*'. In this example, the first and second lighting modules 206*a*, 206*a*' comprise one or more light sources arranged for emitting light. Based on the orientation of the lighting modules 206*a*, 206*a*' relative to the housing 202*a*, the processor determines the light output of the lighting modules 206*a*, 206*a*'. The processor may, for example, determine to control the light output of the first lighting module 206*a* (oriented upwards) according to an ambient light setting (e.g. a warm yellow colour to illuminate the ceiling) and to control the light output of the second lighting module 206*a*' (oriented downwards) according to a task light setting (e.g. a cool white colour to illuminate the surface, e.g. a table, underneath the pendant lamp).

FIG. 2*b* shows schematically an embodiment of a luminaire 200*b* according to the invention comprising a first connector 204*b*, a second connector 204*b*' and a third connector 204*b*" for interfacing with a first lighting module 206*b*, a second lighting module 206*b*' and a third lighting module 206*b*". The first connector 204*b* is located at the left side of housing 202*b* of the luminaire 200*b*, and it is oriented downwards. The second connector 204*b*' is located at the center of the housing 202*b* of the luminaire 200*b*, and it is also oriented downwards. The third connector 204*b*" is located at the right side of the housing 202*b* of the luminaire 200*b*, and it is also oriented downwards. In the exemplary embodiment of FIG. 2*b*, the positions (location and/or orientation) of the connectors 204*b*, 204*b*', 204*b*" are fixed relative to the housing 202*b*. The luminaire 200*b* may, for example be a troffer installed in the ceiling. A user may connect the first lighting module 206*b*, the second lighting module 206*b*' and the third lighting module 206*b*' to the first, second and third connectors 204*b*, 204*b*', 204*b*" respectively. In this example, the first, second and third lighting modules 206*b*, 206*b*', 206*b*" may comprise one or more light sources arranged for emitting light. Based on the location of the lighting modules 206*b*, 206*b*', 206*b*" relative to the housing 202*b*, the processor determines the light output of the lighting modules 206*b*, 206*b*', 206*b*". The processor may, for example, determine to set the light output of the first lighting module 206*b* to a red light setting and to set the light output of the third lighting module 206*b*" to a yellow light setting based on their location relative to the housing 202*b*. In order to create a consistent light effect (e.g. a gradually changing colour from red to yellow), the processor may determine to set the light output of the second lighting module 206*b*' to an orange light setting based on its location relative to the housing 202*b*.

The luminaire 100 may further comprise an orientation sensor for providing an orientation signal. This allows the processor 108 to determine the orientation of the connector 104, 105 relative to the housing 102 based on the orientation signal. The next examples, as illustrated in FIGS. 3*a* and 3*b*, explain how the processor may determine the orientation of the lighting module based on the orientation signal.

Figure 3A:
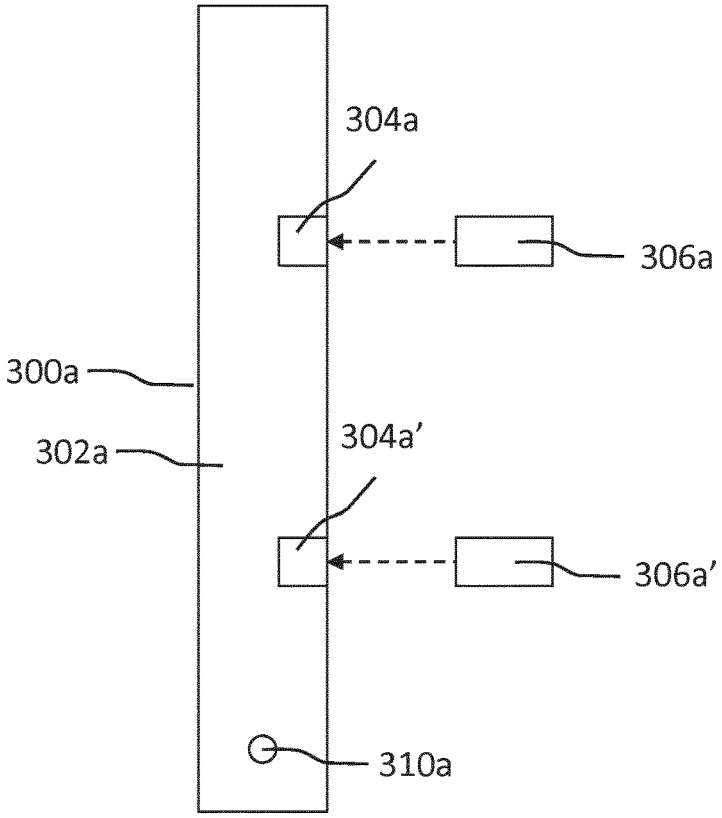
FIG. 3*a* shows schematically an embodiment of a luminaire according to the invention comprising an orientation sensor in the housing of the luminaire.

In a first example, as illustrated in FIG. 3*a*, the orientation sensor 310*a* is located at the housing 302*a* of the luminaire 300*a*. This is beneficial if the connectors 304*a*, 304*a*' have a fixed orientation relative to the housing 302*a*. The orientation sensor 310*a* may be arranged for detecting an orientation and/or a location of the luminaire. The orientation sensor 310*a* may for example detect that the luminaire 300*a* is installed in a vertical orientation and the processor may control the light output of the lighting modules 306*a*, 306*a*' based on this detection.

Figure 3B:
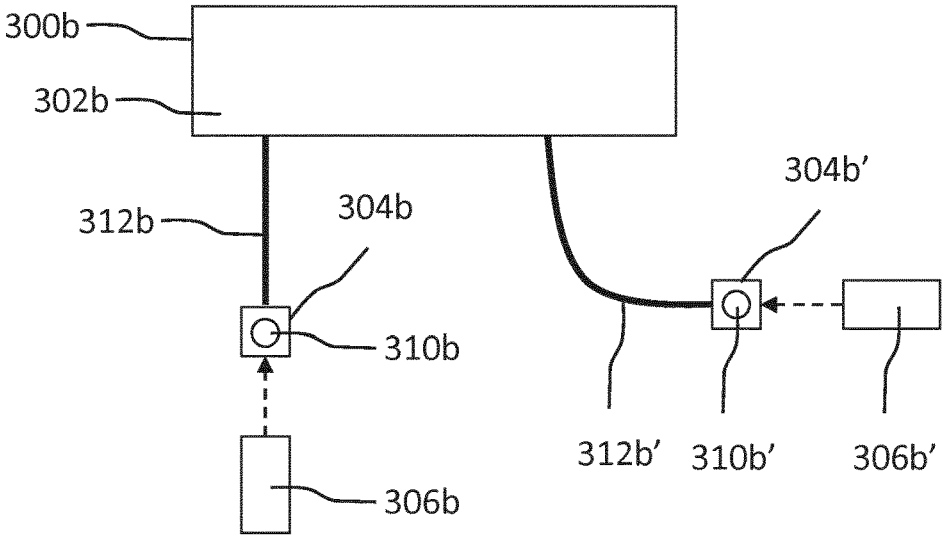
FIG. 3*b* shows schematically an embodiment of a luminaire according to the invention comprising a first orientation sensor at a first connector and a second orientation sensor at a second connector.

In a second example, as illustrated in FIG. 3*b*, the orientation sensors 310*b*, 310*b*' are located at the connectors 304*b*, 304*b*' of the luminaire 300*b*. This is advantageous when the orientation of the connector is not fixed relative to the orientation of the housing 302*b*. The luminaire 300*b* may, for example, further comprise a first connector orientation adjustment element 312*b* and a second connector orientation adjustment element 312*b*', which connector orientation adjustment elements 312*b*, 312*b*' are arranged for adjusting the orientation of the connectors 304*b*, 304*b*' relative to the orientation of the housing 302*b*. The connector orientation adjustment elements 312*b*, 312*b*' (e.g. flexible/bendable rods, rods comprising one or more moveable joints, or any other mechanically operable adjustable means) couple the connectors 304*b*, 304*b*' to the housing 302*b* and allow a user or the processor to change the location and/or the orientation of the connectors 304*b*, 304*b*'. Orientation sensor 310*b* may for example detect that the connector 304*b* is oriented downwards, and orientation sensor 310*b*' may for example detect that the connector 304*b*' is oriented horizontally. The orientation sensors 310*b*, 310*b*' may be arranged for generating the orientation signals based on the detected orientation and/or location, and for communicating the orientation signals to the processor 108, which determines the light output of the lighting modules 306*b*, 306*b*' based on the orientation signals.

Figure 4:
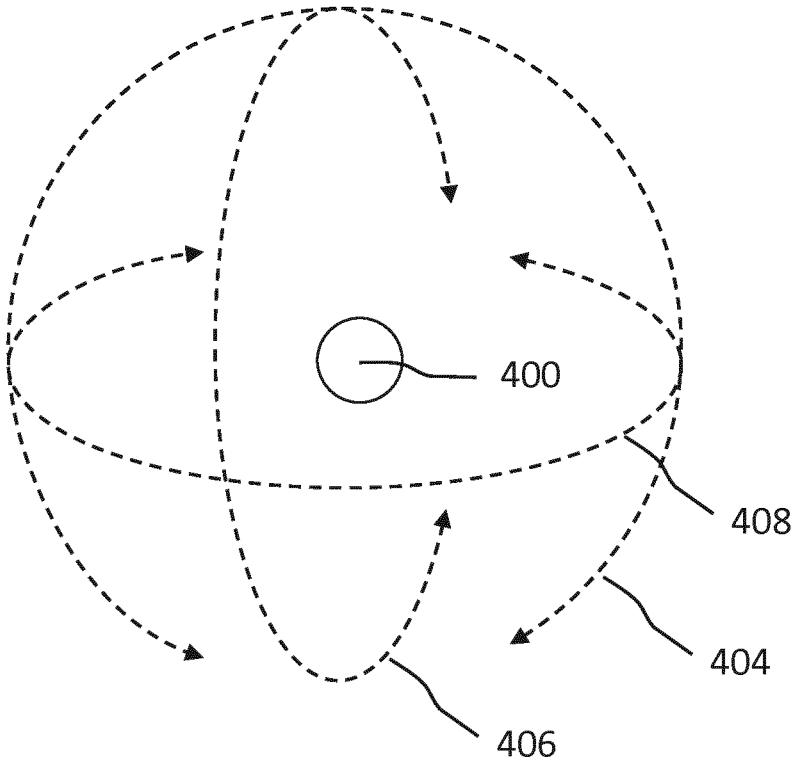
FIG. 4 shows schematically an embodiment of an orientation sensor.
Figure 4:
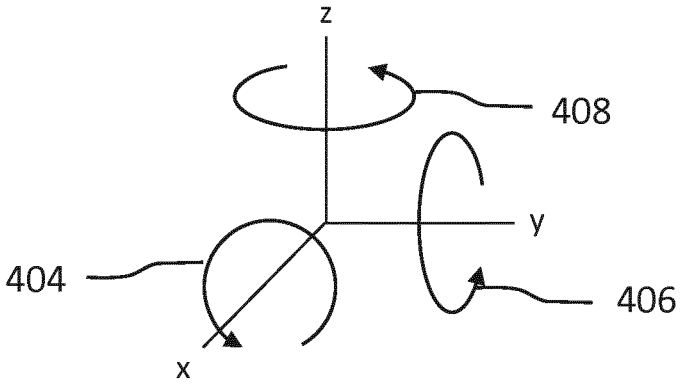

FIG. 4 shows schematically an embodiment of an orientation sensor for detecting an orientation relative to the gravitational field. The orientation sensor 400 may be arranged for detecting an orientation of the luminaire 100 or a connector 104, 105 relative to the gravitational field. The orientation sensor 400 may comprise one or more accelerometers, one or more gyroscopes, one or more magnetometers, one or more tilt sensors, etc. in order to determine the orientation of the luminaire 100. The orientation of the luminaire 100 may be defined by the roll 404, pitch 406 and yaw 408 of the luminaire 100 around the X, Y and Z axes respectively. Upon detecting the orientation of the luminaire 100, the orientation sensor 400 may generate an orientation signal in order to communicate the orientation to the processor 108. The processor 108 may determine the orientation of the lighting module 106 based on the orientation signal and control the light output of the lighting module based on the orientation 400.

Each connector 104, 105 is arranged for interfacing with a lighting module comprising at least one light source (e.g. an LED light source, an incandescent light source, a fluorescent light source, etc.). The processor 108 is arranged for controlling the light output of the at least one light source based on the position (the location relative to the housing 102 and/or the orientation) of the lighting module. For example, an upward facing light emitting module may emit coloured light at a low intensity, while a downward facing light emitting module may emit white light at a high intensity.

Additionally or alternatively, each connector 104, 105 may be arranged for interfacing with a sensor module comprising at least one sensor (e.g. a temperature sensor, a light sensor, a camera, etc.) arranged for detecting an environmental condition of the connector 104, 105 or the luminaire 100, and the processor 108 may be arranged for setting the mode of operation of the sensor module based on the position of the sensor module. The sensor module may, for example, comprise a audio sensor. Depending on the position (location and orientation) of the audio sensor, the processor 108 may determine to set a first mode of operation or a second mode of operation. In the first mode of operation, the audio sensor may, for example, be set to a high sensitivity, while in the second mode of operation, the audio sensor may be set to a low sensitivity. This may be advantageous if the audio sensor is arranged for receiving voice input. For example, an upward facing audio sensor may require a louder noise, and therefore require a higher sensitivity, while a downward facing audio sensor may require a less loud noise, and therefore require a lower sensitivity.

The luminaire 100 comprises a plurality of connectors 104, 105. In an embodiment, a first connector may be interfacing with a light emitting module, and a second connector may be interfacing with a sensor module. The processor 108 may determine the light output of the light emitting module based on sensor information from the sensor module. The sensor module may for example comprise an occupancy sensor arranged for detecting the presence of a plurality of people. The processor 108 may determine to control the light emitting module according to a first light output, e.g. a task lighting setting, when one person is detected, or to a light output, e.g. an ambient light setting, when a plurality of persons are detected, or to a 'low energy' mode when no people are detected. Alternatively, the processor 108 may determine the mode of operation of the sensor module based on a current light output. The light emitting module may for example comprise one or more light sources for providing cool bright lighting and, alternatively, for providing less bright coloured lighting. The processor 108 may determine to set the sensor module, which for example comprises a camera to detect the presence of objects and/or people, to a first mode of operation, e.g. a low sensitivity when the light emitting module emits cool bright lighting, or to a second mode of operation, e.g. a high sensitivity when the light emitting module emits less bright coloured lighting.

The luminaire 100 may be further arranged for receiving control commands from a further device, such as a user interface device (e.g. a smartphone, a smart watch, a tablet pc, etc.). Such a control command may, for example, comprise instructions for applying a specific light setting to the luminaire 100. The light setting, for example a rainbow light effect, may be selected by a user operating the user interface device. The processor 108 of the luminaire 100 may be further arranged for setting the mode of operation further based on the user input. Based on, for example, the selection of the rainbow effect (red, orange, yellow, green, blue, purple), the processor 108 may determine to control the light output of a first lighting module 106 connected to a first connector to emit light according to a first colour of the rainbow, and to control the light output of five other connectors accordingly such that they emit light according to the other five colours of the rainbow. Such a light effect may also be a dynamic light effect (i.e. a light effect that changes hue, saturation and/or brightness over time).

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processing unit. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A luminaire for controlling a light output of a lighting module comprising at least one light source, the luminaire comprising:

a housing, a plurality of connectors for interfacing with the lighting module, wherein each connector has a position defined by a location relative to the housing and an orientation relative to the gravitational field, and wherein at least two connectors have different orientations, and a processor for detecting the lighting module at a connector for accessing information indicative of the position of the connector, for identifying the lighting module based on a signal received from the lighting module, and for controlling the light output of the lighting module based on the identification of the lighting module and the position of the connector.

2. The luminaire of claim 1, wherein the luminaire comprises an orientation sensor for providing an orientation signal indicative of the orientation of the orientation sensor to the processor, and wherein the processor is further arranged for determining the orientation of the connector based on the orientation signal.

3. The luminaire of claim 2, wherein the orientation sensor is located in the housing of the luminaire.

4. The luminaire of claim 3, wherein the orientation of the connector is fixed relative to the orientation of the housing, and wherein the processor is further arranged for determining the orientation of the connector based on the orientation of the housing.

5. The luminaire of claim 2, wherein the orientation sensor is located in the connector.

6. The luminaire of claim 5, wherein the luminaire further comprises a connector orientation adjustment element, which connector orientation adjustment element is arranged for adjusting the orientation of the connector relative to the orientation of the housing.

7. The luminaire of claim 1, wherein the processor is further arranged for controlling the light output of a further lighting module connected to a further connector of the plurality of connectors based on the light output of the lighting module.

8. The luminaire of claim 1 further comprising the lighting module, the lighting module comprising:

a second connector for interfacing with one of the plurality of connectors of the luminaire, and a second processor arranged for controlling the light output of the lighting module based on a control signal received from the luminaire.

9. A method of controlling a light output of a lighting module comprising at least one light source, the method comprising the steps of:

detecting the lighting module at a connector of a plurality of connectors, wherein each connector has a position defined by a location relative to a housing of a luminaire and an orientation relative to the gravitational field, and wherein at least two connectors have different orientations, accessing information indicative of the position of the connector, identifying the lighting module based on a signal received from the lighting module, and controlling the light output of the lighting module based on the identification of the lighting module and the position of the connector.

10. The method of claim 9, further comprising the step of detecting the orientation of the connector.

* * * * *